US006413471B1

(12) United States Patent
Kamikawa et al.

(10) Patent No.: US 6,413,471 B1
(45) Date of Patent: Jul. 2, 2002

(54) APPARATUS FOR PRODUCING REDUCED IRON

(75) Inventors: Susumu Kamikawa; Kouichi Hirata; Hironori Fujioka; Hideaki Mizuki; Keiichi Sato; Akihiro Santo, all of Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/612,322

(22) Filed: Jul. 7, 2000

(30) Foreign Application Priority Data

Sep. 7, 1999 (JP) ..... 11-252642

(51) Int. Cl.[7] ..... C21B 7/16
(52) U.S. Cl. ..... 266/177; 432/138
(58) Field of Search ..... 266/177, 281; 75/484; 432/124, 138

(56) References Cited

U.S. PATENT DOCUMENTS 5,972,066 A * 10/1999 Lehtinen ..... 75/484
5,989,019 A * 11/1999 Nishimura et al. ..... 75/484
6,254,665 B1 * 7/2001 Matsushita et al. ..... 75/484

FOREIGN PATENT DOCUMENTS

JP 2000129323 A * 5/2000

* cited by examiner

*Primary Examiner*—Scott Kastler

(57) ABSTRACT

An apparatus for producing reduced iron by agglomerating a mixed powder of an iron material and a reducing agent to form compacts like briquettes or pellets, and reducing the compacts in a high temperature atmosphere is disclosed. In the apparatus, a rotary hearth in an annular form is rotatably supported. Right and left furnace walls and a ceiling are provided to cover an area above the rotary hearth, thereby forming a space portion in a high temperature atmosphere. A compact supply portion, and a compact discharge portion are provided adjacently in the ceiling. Partitioning members are provided as partitions between the compact supply portion, the compact discharge portion, and the high temperature atmosphere space portion.

13 Claims, 14 Drawing Sheets

APPARATUS FOR PRODUCING REDUCED IRON

BACKGROUND OF THE INVENTION

1. Field of the Invention

The present invention relates to an apparatus for producing reduced iron by mixing an iron material and a reducing agent to form a mixed powder, agglomerating the mixed powder to form compacts like pellets, or briquettes and reducing the compacts in a high temperature atmosphere.

2. Description of the Related Art

To produce reduced iron, the first step is to mix an iron ore powder, a coal powder, a fluxstone (limestone) powder, and a binder, and humidify and agglomerate the mixture to form wet compacts called green compacts. Then, the wet compacts are dried to some degree. The dried compacts are heated to a high temperature in a reducing furnace (a rotary hearth furnace, RHF), where iron oxide in the iron ore is reduced with the coal to form reduced iron compacts.

FIG. 13 shows a vertical section of a conventional RHF. FIG. 14 shows a section of a compact supply portion in the conventional RHF.

As shown in FIGS. 13 and 14, a conventional RHF 001 has a pair of parallel rails 003 mounted in an annular formon a circular base 002 installed on a floor surface. To a lower surface of an annular hearth 004, a plurality of pairs of (right and left) wheels 005 are attached along a peripheral direction. The wheels 005 can roll on the rails 003. On the base 002, vertical frames 006 are erected inwardly and outwardly of the rails 003. On an upper portion of the inner and outer vertical frames 006, furnace walls 007 are fixed on both sides of the hearth 004. On top of the furnace walls 007, a ceiling 008 is fixed to cover an area above the hearth 004.

Inside the RHF 001, a space portion S for forming a high temperature atmosphere is defined by the hearth 004, the right and left furnace walls 007, and the ceiling 008. On the furnace walls 007, a multiplicity of burners 009 are provided for heating the space portion S. To the right and left vertical frames 006, water sealing portions 010 by water seal are attached. A lower end portion of a skirt 011 fixed to the furnace wall 007, and a lower end portion of a skirt 012 fixed to the hearth 004 are submerged in the water sealing portion 010.

At a predetermined position of the RHF 001, a compact supply portion 013 for supplying green compacts (raw compacts) onto the hearth 004, and a compact discharge portion 014 for discharging reduced compacts (reduced iron) reduced on the hearth 004 to the outside are provided adjacently. That is, a low ceiling portion 015 is provided detachably in correspondence with the compact supply portion 013. In the ceiling portion 015, a compact acceptance opening 015*a* is formed. Above the ceiling portion 015, a compact supply hopper 016 and a vibrating feeder 017 having a compact supply port 017*a* are provided. A low ceiling portion 018 is provided detachably in correspondence with the compact discharge portion 014. In the ceiling portion 018, a compact discharging screw 019 is provided.

Thus, dried green compacts are heaped in the compact supply hopper 016 in the compact supply portion 013, and supplied onto the hearth 004 by the vibrating feeder 017 through the compact acceptance opening 015*a* via the compact supply port 017*a*. The hearth 004 rotates at a predetermined speed in the direction of an arrow T in FIG. 14, and forms a high temperature atmosphere upon heating of the space portion S by the burners 009. Hence, while the green compacts on the hearth 004 are moving in the high temperature atmosphere, iron oxide in the iron ore is reduced with the coal to become reduced iron. In the compact discharge portion 014, the reduced green compacts are discharged out of the furnace by the compact discharging screw 019, and packed into a container (not shown).

To produce direct-reduced iron having a high degree of metallization in a reduced iron production process in the RHF 001, it is important to prevent direct-reduced iron after reduction from becoming reoxidized. Thus, a task for discharge from the compact discharge portion 014 is performed such that direct-reduced iron is carried under airtight conditions into the container, and passed on to a subsequent step.

With the conventional RHF 001, the green compacts supplied from the compact supply portion 013 onto the hearth 004 are immediately heated with a high temperature gas inside the furnace. To avoid the situation that the high temperature gas flows reversely and gushes from the compact supply portion 013 (compact supply port 017*a*, compact acceptance opening 015*a*), the high temperature gas inside the furnace is discharged through an off-gas duct (not shown) to keep the interior of the furnace at a negative pressure. Hence, when the green compacts are supplied from the compact supply portion 013 onto the hearth 004, outside air F enters the furnace together with the green compacts, and divides into air $F_1$ directed forward in the direction of rotation of the hearth 004, and air $F_2$ directed rearward in the direction of rotation of the hearth 004, i.e., toward the compact discharge portion 014, as shown in FIG. 14. The air $F_2$ directed toward the compact discharge portion 014 contacts the direct-reduced iron to be discharged from the compact discharge portion 014, reoxidizing the direct-reduced iron and lowering the degree of metallization.

As shown in FIG. 13, both sides of the hearth 004 are sealed by the submersion of the skirts 011, 012 in the water sealing portion 010 to prevent the outflow of the high temperature gas inside the furnace, and the inflow of the outside air. As stated earlier, however, air enters the furnace from the compact supply portion 013, because the interior of the furnace is maintained at a negative pressure. This air flows in the entire periphery of the RHF 001 through a space portion Q above the water sealing portion 010, adversely affecting the high temperature atmosphere and the regulation of the pressure inside the furnace.

SUMMARY OF THE INVENTION

The present invention has been accomplished to solve the above-mentioned problems. It is an object of this invention to provide an apparatus for producing reduced iron, which can produce reduced iron at a high degree of metallization by preventing entry of the outside air into an RHF, and which can increase the operating efficiency of the RHF.

An apparatus for producing reduced iron according to the invention, designed to attain the above object, is an apparatus for producing reduced iron by agglomerating a mixed powder of an iron material and a reducing agent to form compacts like pellets, or briquettes and reducing the compacts in a high temperature atmosphere, comprising:

a rotary hearth in an annular form and rotatably supported;

a frame for covering an area above the rotary hearth to form a high temperature atmosphere space portion;

a compact supply portion for supplying the compacts onto the rotary hearth;

a compact discharge portion for outwardly discharging reduced iron reduced on the rotary hearth; and supply portion partitioning means as a partition between the compact supply portion and the high temperature atmosphere space portion.

Thus, even if the outside air enters the furnace from the compact supply portion, the partitioning means suppresses air flow to the high temperature atmosphere space portion and the compact discharge portion, and prevents reoxidation of direct-reduced iron. This makes it possible to produce direct-reduced iron having a high degree of metallization. Also by diminishing the influence on the high temperature atmosphere or the regulation of pressure inside the furnace, the operating efficiency can be increased.

In the apparatus for producing reduced iron according to the invention, discharge portion partitioning means may be provided as a partition between the compact discharge portion and the high temperature atmosphere space portion. Thus, air flow from the compact discharge portion to the high temperature atmosphere space portion is suppressed to diminish the influence on the high temperature atmosphere or the regulation of pressure inside the furnace. Consequently, the operating efficiency can be increased.

In the apparatus for producing reduced iron according to the invention, the supply portion partitioning means may be a partitioning member suspended from a ceiling of the frame and positioned above the rotary hearth. Accordingly, a simple layout can suppress air flow from the compact supply portion to the high temperature atmosphere space portion on the rotary hearth.

In the apparatus for producing reduced iron according to the invention, the supply portion partitioning means may be a partitioning member provided beside the rotary hearth. Thus, air which has entered a gas passage space portion formed beside the rotary hearth can be inhibited from flowing through the entire periphery of the RHF. Consequently, the influence on the high temperature atmosphere or on the regulation of pressure inside the furnace can be diminished.

In the apparatus for producing reduced iron according to the invention, the area above the rotary hearth may be covered by the frame, whereby the high pressure atmosphere space portion may be formed above the rotary hearth, and a gas passage space portion may be formed beside the rotary hearth, a water sealing portion may be provided beside the rotary hearth, a lower end portion of a skirt beside the rotary hearth and a lower end portion of a skirt beside the frame may be submerged in the water sealing portion, and partition plates as the supply portion partitioning means may be provided in the high temperature atmosphere space portion and the gas passage space portion. Thus, air flow from the compact supply portion and the gas passage space portion to the high temperature atmosphere space portion and the compact discharge portion can be suppressed to diminish the influence on the high temperature atmosphere or on the regulation of pressure inside the furnace. Moreover, reoxidation of reduced iron can be prevented.

In the apparatus for producing reduced iron according to the invention, burners for heating the high temperature atmosphere space portion may be provided in the frame, and an off-gas duct may be provided for discharging a high temperature gas to keep an interior of the apparatus at a negative pressure. Thus, the high temperature atmosphere space portion is heated by the burners, and kept at a negative pressure by the action of the off-gas duct. As a result, gas outflow from the compact supply portion and the compact discharge portion can be prevented, so that the high temperature atmosphere space portion can be maintained properly in a predetermined temperature atmosphere.

In the apparatus for producing reduced iron according to the invention, the partitioning member may be formed like a mattress by enveloping bulked ceramic fibers in a woven fabric-like ceramic sheet, and may be attached to the ceiling of the frame. Thus, the partitioning member can be made lightweight, and since the partitioning member is made of flexible materials, its damage due to contact can be prevented.

The apparatus for producing reduced iron according to the invention may include moving means for moving the partitioning member upward and downward, height detecting means for detecting a height of compacts on the rotary hearth, and control means for controlling operation of the moving means in accordance with results of detection by the height detecting means. Thus, even if the height of compacts on the hearth varies with the amount of supply of compacts supplied onto the rotary hearth, the gap between a lower end portion of the partitioning member and the compacts can be constantly maintained at an appropriate level, by adjusting the height position of the partitioning member. Consequently, flow of air inside the furnace can be suppressed reliably, and damage to the partitioning member can be prevented.

In the apparatus for producing reduced iron according to the invention, the partitioning member may be formed by surrounding an entire surface of a steel plate as a core material with an incombustible heat resistant material. Thus, the partitioning member can be prevented from being deformed or damaged.

In the apparatus for producing reduced iron according to the invention, the supply portion partitioning means may be a gas curtain formed by ejecting an inert gas from a gas ejection nozzle formed in the frame toward the rotary hearth. Thus, air flow inside the furnace can be easily suppressed.

In the apparatus for producing reduced iron according to the invention, the partitioning member may be a partition plate of stainless steel having flexibility and capable of elastic deformation. Thus, even if a front end portion of the partition plate contacts a side portion of the rotary hearth, the partition plate elastically deforms, thus preventing damage to the rotary hearth.

In the apparatus for producing reduced iron according to the invention, the partitioning member may be formed like a mattress by enveloping bulked ceramic fibers in a woven fabric-like ceramic sheet, and may be attached to a side wall of the frame. Thus, the partitioning member can be made lightweight, and since the partitioning member is made of flexible materials, its damage due to contact can be prevented.

In the apparatus for producing reduced iron according to the invention, high temperature atmosphere space portion partitioning means may be provided as partitions at least between a heating zone, a CO ratio control zone, and a reducing atmosphere zone in the high temperature atmosphere space portion. Thus, air flow in a side portion of the frame between the respective zones can be suppressed, and the CO ratio in each of the zones can be controlled appropriately. Consequently, reduced iron having a high degree of metallization can be produced.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Embodiments of the present invention will now be described in detail with reference to-the accompanying drawings, which in no way limit the invention.

[First Embodiment]

Figure 6:
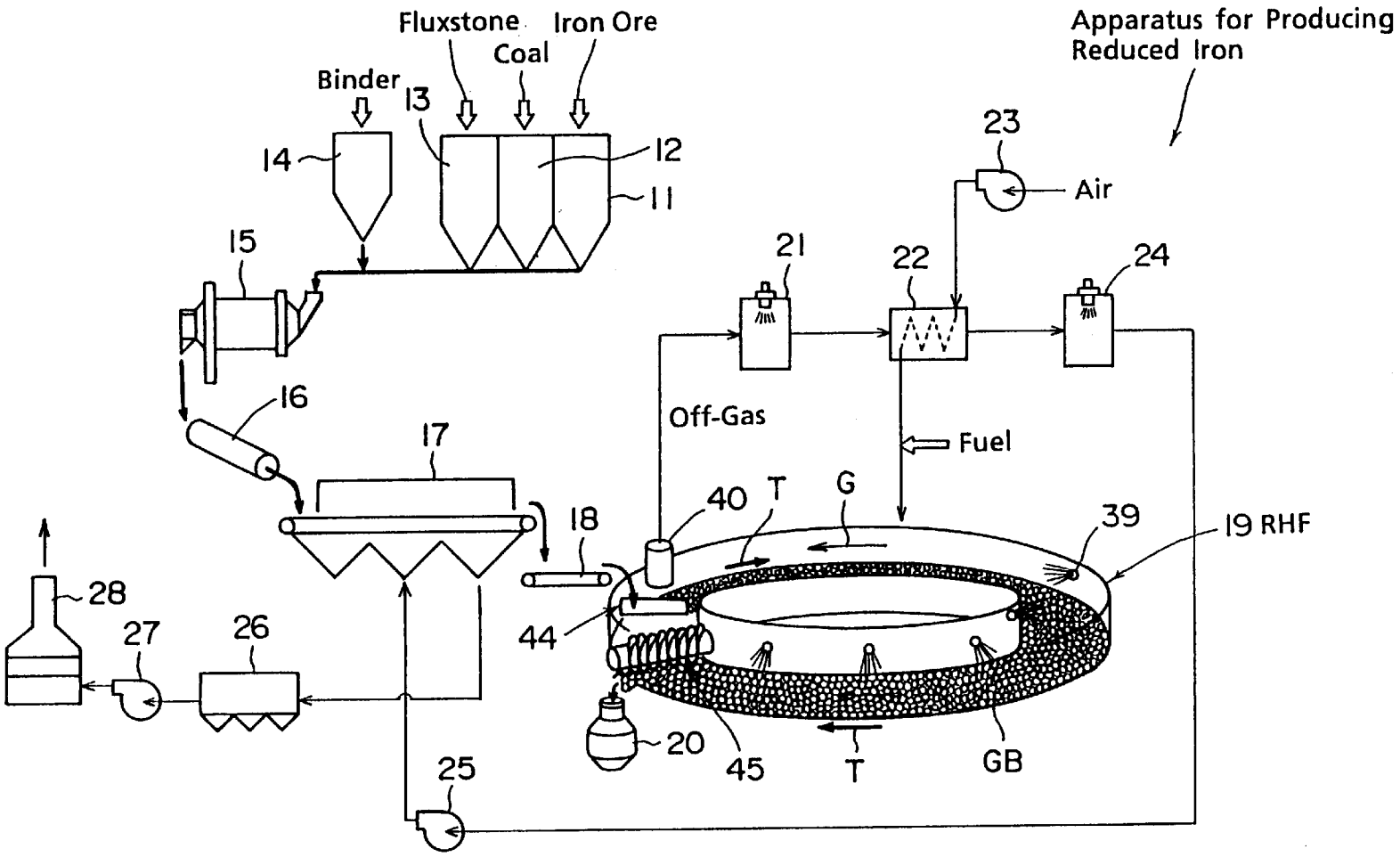
FIG. 6 is a schematic view showing an entire structure of the apparatus for producing reduced iron.

A production process by an apparatus for producing reduced iron according to the present embodiment will be described briefly. As shown in FIG. 6, an iron ore powder (an iron material), a coal powder (a reducing agent), and a fluxstone (limestone) powder, which will be raw materials for compacts, are fed from hoppers 11, 12 and 13, respectively. Separately, a binder is fed from a hopper 14, and these materials are mixed in a mixer 15. Then, the resulting mixed powder is agglomerated by a pelletizer or a briquetter 16 to form green compacts (raw compacts) like pellets or briquettes. The resulting compacts are charged into a dryer 17, where the compacts are dried with an off-gas from an RHF 19 to be described later on. The so dried green compacts are fed to the RHF 19 by a conveyor 18, and heated at a high temperature inside the RHF 19 while moving in the RHF 19. Iron oxide in the iron ore is reduced with coal to form reduced iron in compact form, which is accommodated into a container 20.

The interior of the RHF 19 is maintained in a high temperature atmosphere upon heating by burners 39, while the off-gas inside the RHF 19 is discharged through an off-gas duct 40. The off-gas is cooled by a water spray type primary cooler 21, and then sent to a heat exchanger 22, where the cooled off-gas is heat exchanged with air fed by a fan 23. Then, the off-gas is cooled again by a water spray type secondary cooler 24. The air heated by the heat exchanger 22 is carried to the RHF 19, and fed into the furnace together with fuel. The off-gas cooled by the secondary cooler 24 is sent to the dryer 17 by a fan 25 to become drying air for the green compacts. The off-gas discharged from the dryer 17 is cleaned by a dust collector 26, sent to a stack 28 by an off-gas fan 27 for desulfurization, and then released into the atmosphere.

The RHF 19 will be described in detail hereinbelow. As shown in FIGS. 1 to 4, a pair of parallel rails 32 are laid in an annular form on a base 31 installed on a floor surface. To an upper surface portion of an annular rotating body 33, an annular hearth 34 is fixed. To a lower surface of the rotating body 33, a plurality of pairs of (right and left) wheels 35 are attached along a peripheral direction. The wheels 35 can roll on the rails 32. On the base 31, vertical frames 36 are erected inwardly and outwardly of the rails 32. To an upper portion of each of the inner and outer vertical frames 36, furnace walls 37 are fixed on both sides of the hearth 34. To upper parts of the inner and outer furnace walls 37, a ceiling 38 is fixed to connect these upper parts together, and cover an area above the hearth 34. A horizontal annular guide rail (not shown) fixed to the rotating body 33 is supported by horizontal guide rollers (not shown) mounted on the base 31, and the rotating body 33 is driven and rotated by a driving device (not shown), whereby the hearth 34 can rotate while being supported by the guide rail.

Inside the RHF 19, a tunnel-shaped high temperature space portion S for forming a high temperature atmosphere is defined by the hearth 34, the right and left furnace walls 37, and the ceiling 38. On the furnace walls 37, a multiplicity of the burners 39 are provided for heating the high temperature space portion S, and the off-gas duct 40 is provided for discharging a high temperature gas inside the furnace. To the right and left vertical frames 36, water sealing portions 41 by water seal are attached. A lower end portion of a furnace wall-side skirt 42 fixed to the furnace wall 37, and a lower end portion of a hearth-side skirt 43 fixed to the hearth 34 are submerged in the water sealing portion 41.

At a predetermined position of the RHF 19, a compact supply portion 44 for supplying green compacts (raw compacts) onto the hearth 34, and a compact discharge portion 45 for discharging reduced compacts (reduced iron) reduced on the hearth 34 to the outside are provided adjacently. That is, a low ceiling portion 46 is provided detachably in correspondence with the compact supply portion 44. In the ceiling portion 46, a compact acceptance opening 47 is formed. Above the ceiling portion 46, a compact supply hopper 48 and a vibrating feeder 50 having a compact supply port 49 are provided. A low ceiling portion 51 is provided detachably in correspondence with the compact discharge portion 45. In the ceiling portion 51, a compact discharging screw 52 is provided.

In the RHF 19 of the present embodiment, partitioning means is provided as partitions between the compact supply portion 44, the compact discharge portion 45, and the high temperature space portion S for forming a high temperature atmosphere. This partitioning means is composed of central partition plates suspended from the ceiling 38 and positioned above the hearth 34, and side partition plates attached to the furnace walls 37 and positioned beside the hearth 34.

That is, central partition plates 53*a*, 53*b* and 53*c* are disposed, respectively, forwardly of the compact supply portion 44 in a direction of rotation of the hearth 34, between the compact supply portion 44 and the compact discharge portion 45, and rearwardly of the compact discharge portion 45 in the direction of rotation of the hearth 34. These central partition plates 53*a,* 53*b* and 53*c* are in a laterally wide plate form, and have upper end portions attached to the lower surface of the ceiling 38. The width of the central partition plate is nearly the same as the width of the hearth 34, and has both side portions in contact with the right and left furnace walls 37. The lower end portion of the central partition plate is separated by a tiny gap from the green compacts on the hearth 34.

Likewise, side partition plates 54*a,* 54*b* and 54*c* are disposed, respectively, forwardly of the compact supply portion 44 in the direction of rotation of the hearth 34, between the compact supply portion 44 and the compact discharge portion 45, and rearwardly of the compact discharge portion 45 in the direction of rotation of the hearth 34, i.e., at the same positions as the central partition plates 53*a,* 53*b* and 53*c,* and also on both sides of the central partition plates 53*a,* 53*b* and 53c. The side partition plates 54*a,* 54*b* and 54*c,* as shown in detail in FIG. 5, each comprise a partition plate body 57 coupled in a T-shape to a square fixing plate 55 by an L-shaped connecting plate 56. The partition plate body 57, as shown in detail in FIG. 4, takes the same shape as a gas passage space portion Q defined by the hearth 34, the furnace wall 37 and the skirts 42, 43. The partition plate body 57 is passed through a mounting hole 42*a* from outside the furnace wall-side skirt 42, and the fixing plate 55 is brought into intimate contact with the furnace wall-side skirt 42. In this state, bolting or welding is performed to fix each of the side partition plates 54*a,* 54*b* and 54*c* so as to partition the gas passage space portion Q.

Figure 1:
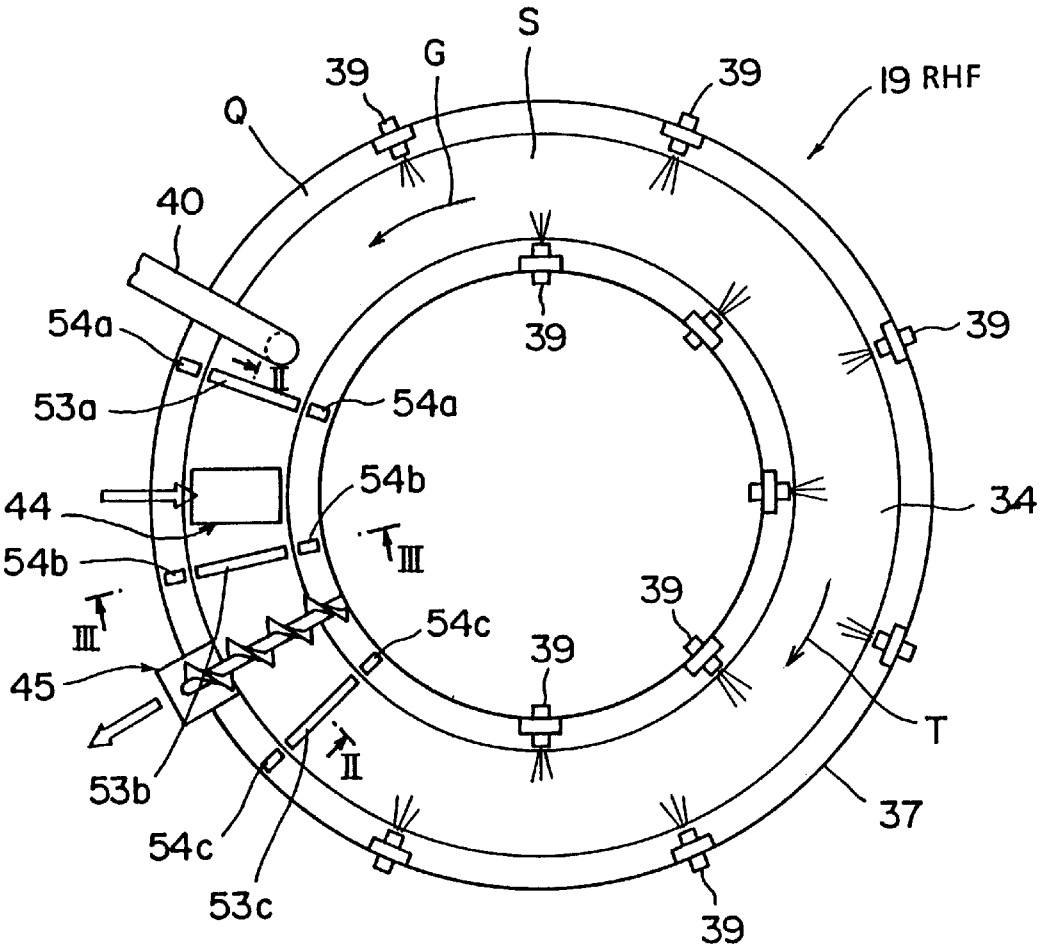
FIG. 1 is a schematic plan view of an RHF in an apparatus for producing reduced iron according to a first embodiment of the present invention.

The action of the RHF 19 in the apparatus for producing reduced iron according to the present embodiment will be described. In the RHF 19, as shown in FIG. 1, the hearth 34 is rotated by a driving device at a predetermined speed in the direction of an arrow T, and forms a high temperature atmosphere upon heating of the high temperature space portion S by the burners 39. The gas in the high temperature space portion S flows in the direction of an arrow G, and is discharged through the off-gas duct 40. In this state, the compacts are supplied at the compact supply portion 44 onto the hearth 34 by the vibrating feeder 50 through the compact acceptance opening 47 via the compact supply port 49. The green compacts supplied into the RHF 19 move together with the hearth 34, and during their movement in the high temperature space portion S, iron oxide in the iron ore is reduced with the coal by the radiant heat of the high temperature gas to become reduced iron. In the compact discharge portion 45, the reduced green compacts are discharged out of the furnace by the compact discharging screw 52, and packed into the container 20.

Figure 2:
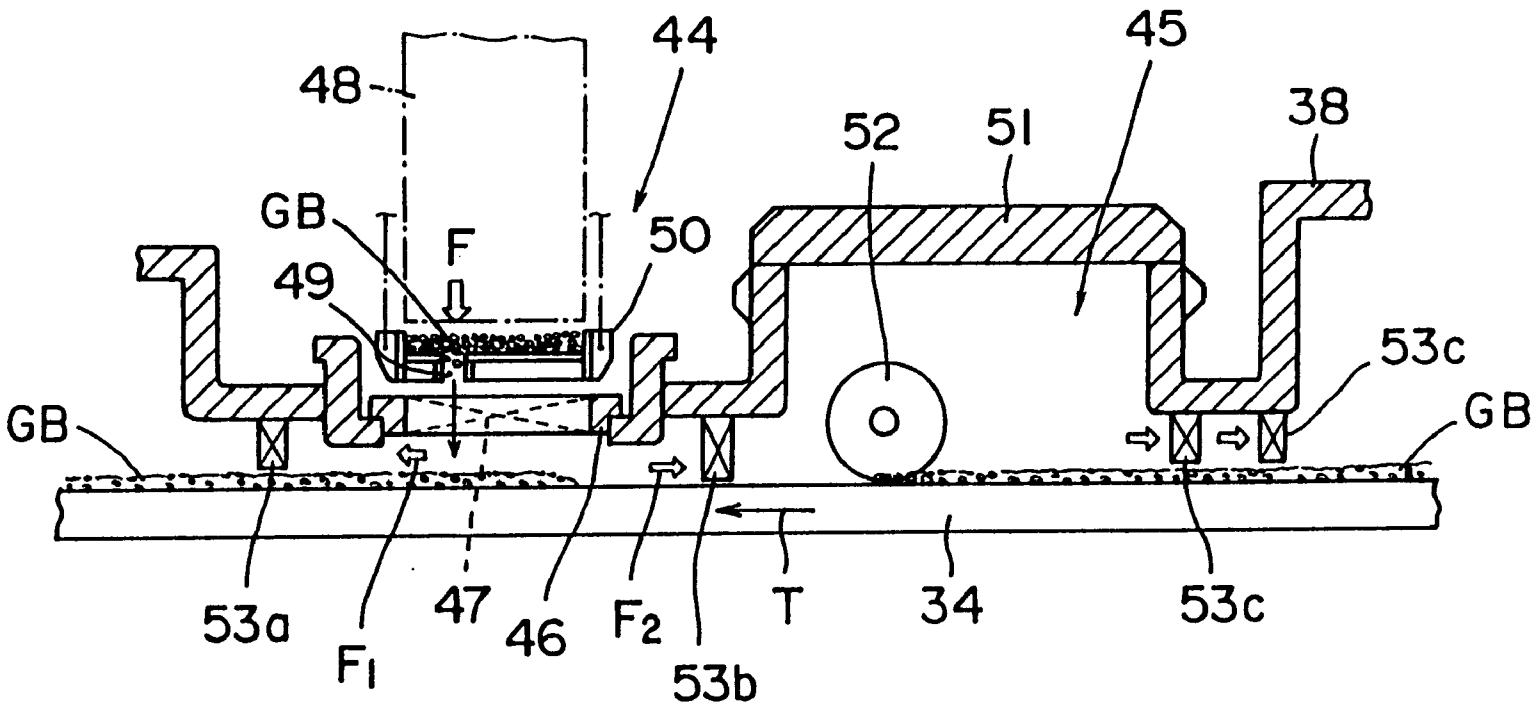
FIG. 2 is a sectional view taken on line II—II of FIG. 1, showing a compact supply portion and a compact discharge portion.
Figure 3:
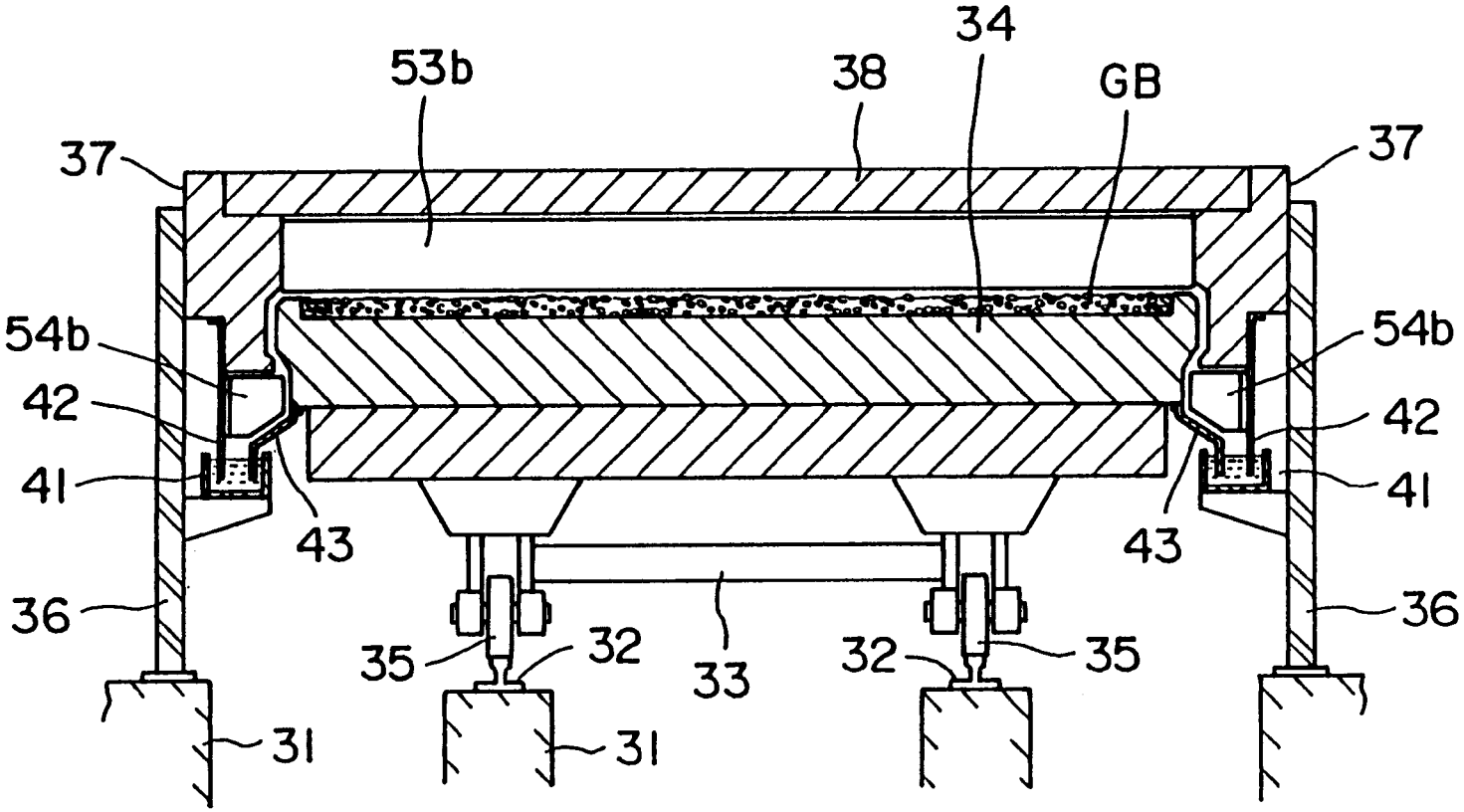
FIG. 3 is a sectional view taken on line III—III of FIG. 1, showing a state of mounting of a partition plate.

With the RHF 19, in order to avoid the situation that the high temperature gas in the furnace flows reversely and gushes from the compact supply portion 44 (compact supply port 49, compact acceptance opening 47), the high temperature gas inside the furnace is discharged through the off-gas duct 40 to keep the interior of the furnace at a negative pressure. Hence, when the green compacts are supplied from the compact supply portion 44 onto the hearth 34, outside air F enters the furnace, as shown in FIG. 2. In the present embodiment, however, the central partition plates 53*a* and 53*b* are disposed ahead of and behind the compact supply portion 44, and the central partition plate 53*c* is disposed rearwardly of the compact discharge portion 45 in the direction of rotation of the hearth 34. Hence, air $F_1$, which has flowed forward in the direction of rotation of the hearth 34 after the entry of the air F into the furnace through the compact supply portion 44, is blocked by the central partition plate 53*a,* and its flow into the high temperature space portion S can be suppressed. Air $F_2$ flowing toward the compact discharge portion 45, on the other hand, is blocked by the central partition plate 53*b*. Thus, this air can be prevented from contacting direct-reduced iron to be discharged from the compact discharge portion 45, and thereby reoxidizing the direct-reduced iron.

Figure 4:
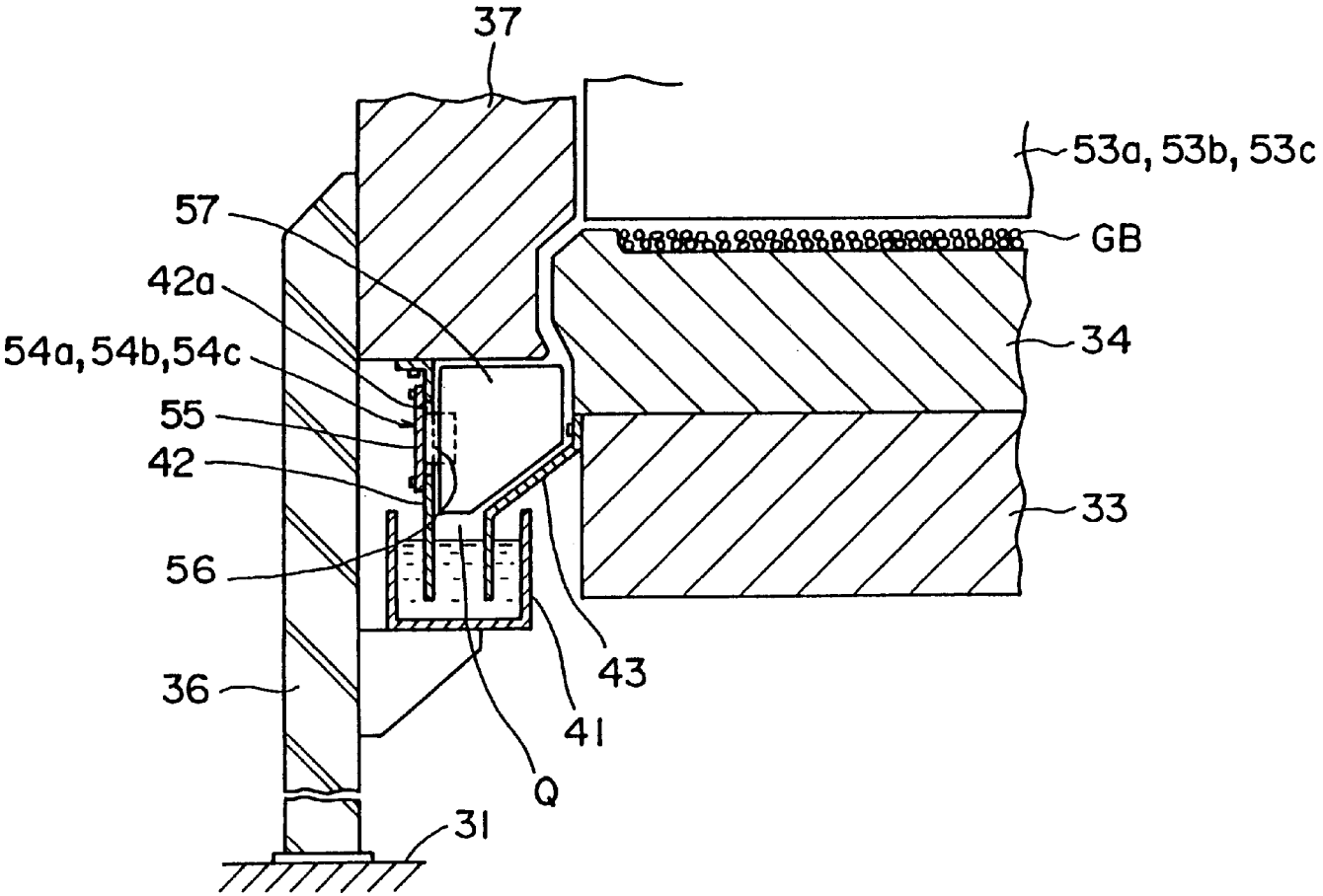
FIG. 4 is a sectional view showing a state of mounting of a side partition plate.
Figure 5:
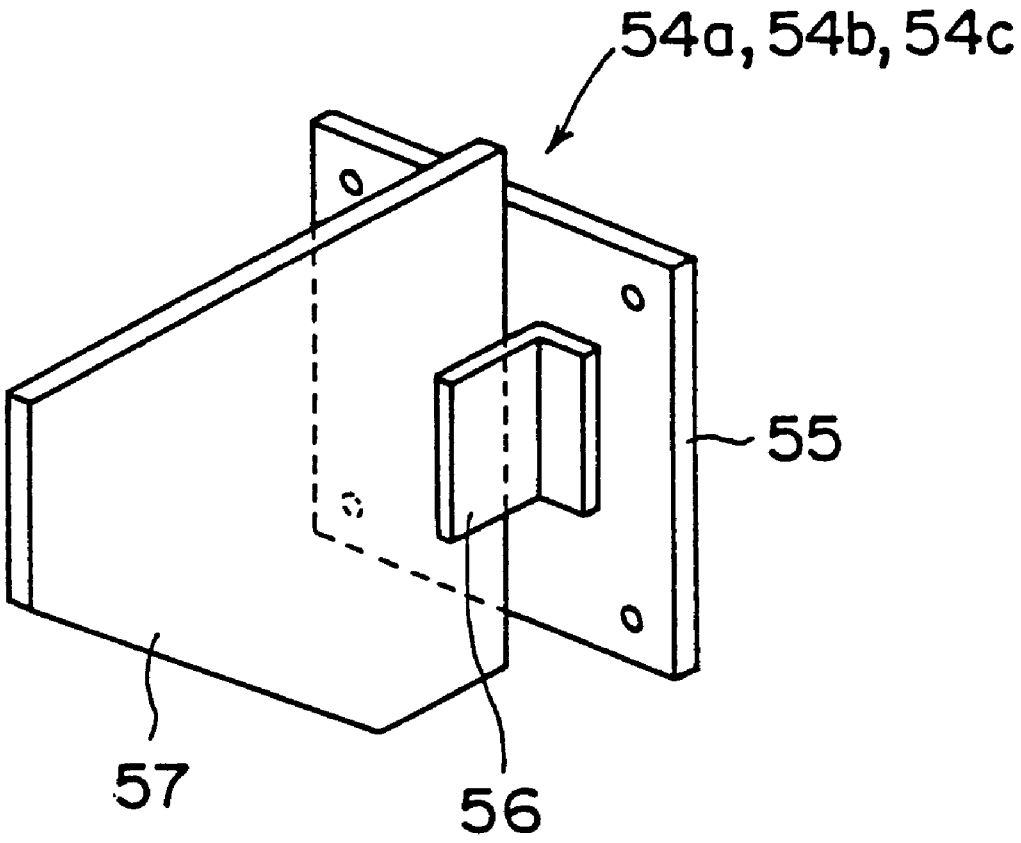
FIG. 5 is a perspective view of the side partition plate.

Air which has entered the furnace from the compact supply portion 44 invades the gas passage space portion Q, as shown in FIG. 4. In the present embodiment, however, the side partition plates 54*a,* 54*b* and 54*c* are disposed, respectively, at the same positions as the central partition plates 53*a,* 53*b* and 53*c,* and also on both sides of the central partition plates 53*a,* 53*b* and 53*c*. Thus, the air that has invaded the gas passage space portion Q, is kept from flowing through the entire periphery of the RHF 19. Consequently, the influence on the high temperature atmosphere and the regulation of pressure inside the furnace can be diminished.

In the RHF 19 of the apparatus for producing reduced iron according to the present embodiment, as described above, the central partition plates 53*a,* 53*b* and 53*c,* and the side partition plates 54*a,* 54*b* and 54*c* suppress the flow of air, which has entered the furnace through the compact supply portion 44, to the high temperature space portion S and the gas passage space portion Q, to prevent reoxidation of direct-reduced iron. This makes it possible to produce direct-reduced iron having a high degree of metallization. Also by diminishing the influence on the high temperature atmosphere or the regulation of pressure inside the furnace, the operating efficiency can be increased.

In the above-mentioned embodiment, the central partition plates 53*a,* 53*b* and 53*c,* and the side partition plates 54*a,* 54*b* and 54*c* have been described as being merely made of plate materials. However, their shapes, structures, and materials are not restricted by the embodiment.

[Second Embodiment]

Figure 7:
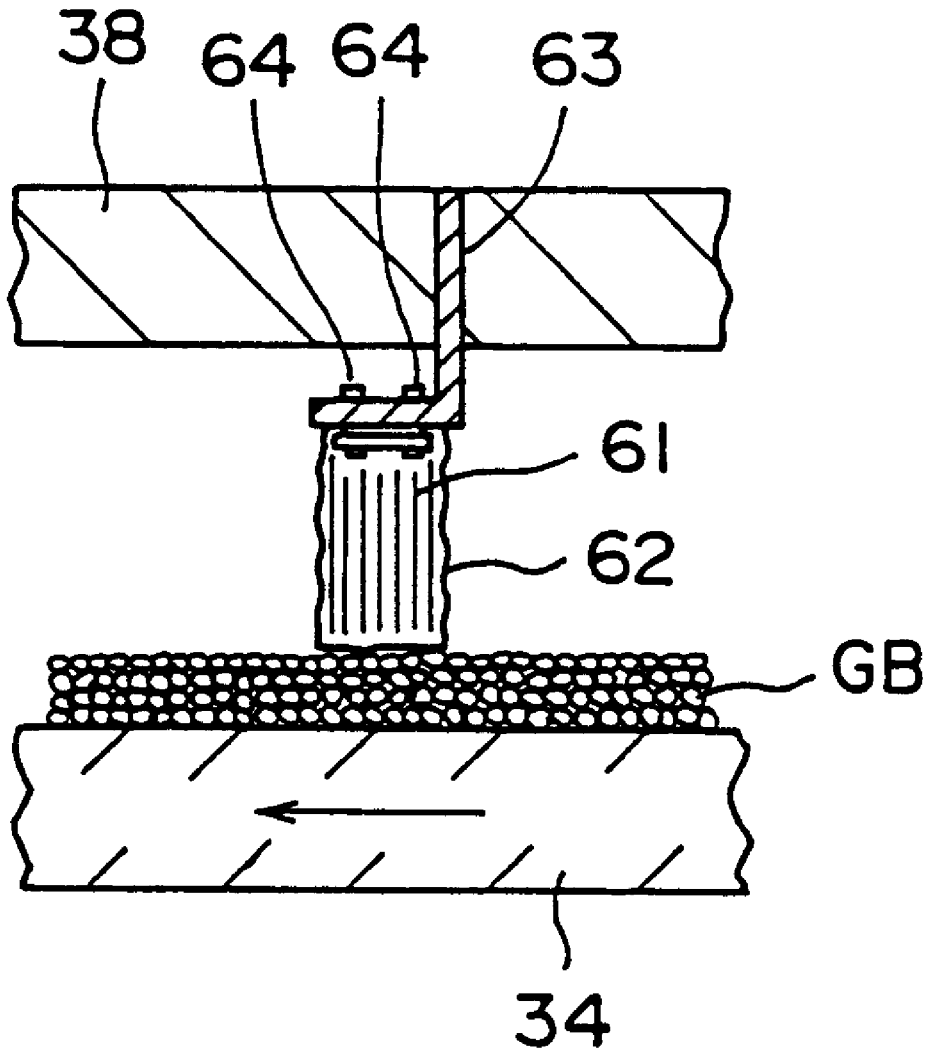
FIG. 7 is a vertical sectional view of an essential part of an RHF showing central partitioning means in an apparatus for producing reduced iron according to a second embodiment of the invention.

As shown in FIG. 7, central partitioning means in the second embodiment is constituted by enveloping slender, rectangular, bulked ceramic fibers 61 of a required size in a woven fabric-like ceramic sheet 62 to form a mattress-like structure, and fixing this structure to an L-shaped mounting bracket 63 by means of bolts 64. The mounting bracket 63 is fixed to the ceiling 38, whereby the central partitioning means is suspended from the ceiling 38 and positioned above the hearth 34, with a lower end portion of the central partitioning means being separated from green compacts by a tiny gap. Thus, the central partitioning means can be made lightweight. Moreover, the central partitioning means is flexible, so that even if it contacts the green compacts on the hearth 34, it adapts to their motion and deforms, whereupon its damage can be prevented.

[Third Embodiment]

Figure 8:
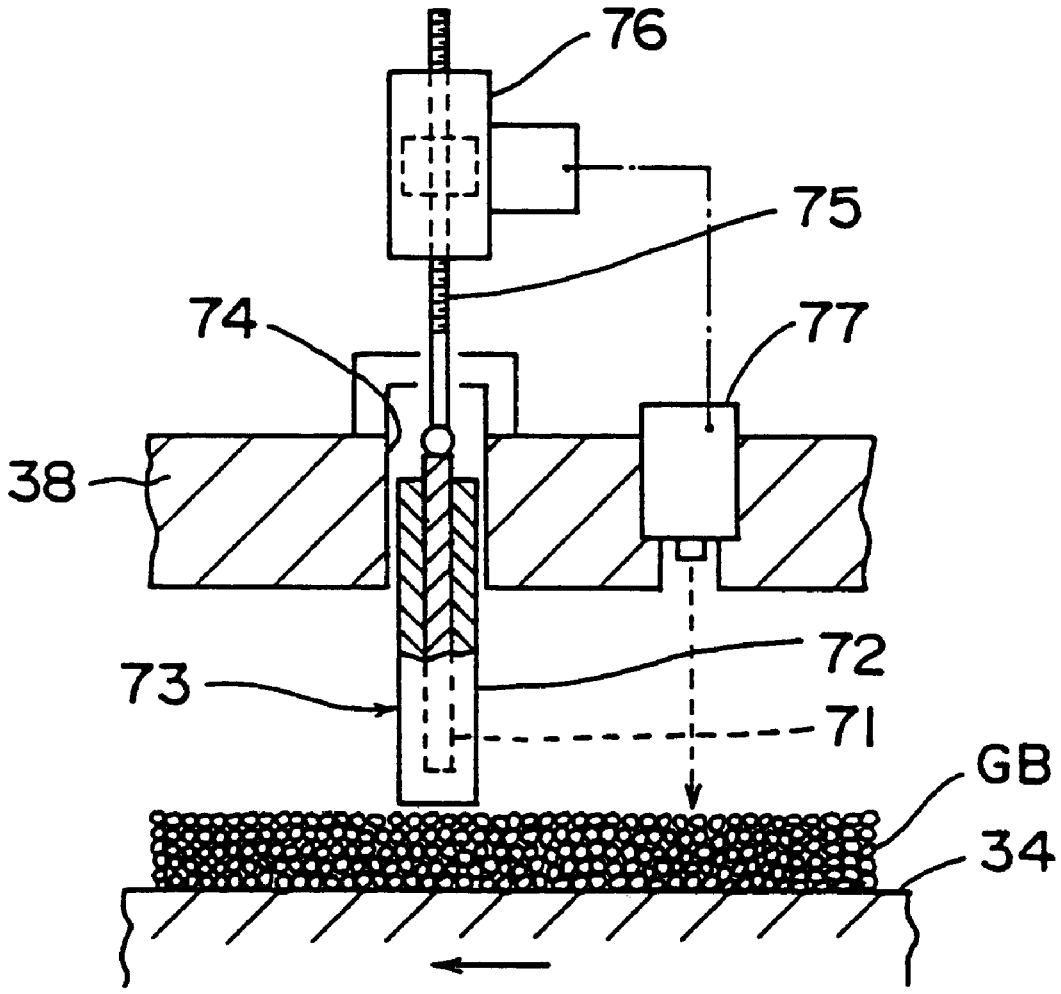
FIG. 8 is a vertical sectional view of an essential part of an RHF showing central partitioning means in an apparatus for producing reduced iron according to a third embodiment of the invention.

As shown in FIG. 8, central partitioning means in the third embodiment is constituted such that an up-and-down partition plate 73 comprising a steel plate 71 as a core material, whose entire surface has been surrounded with an incombustible heat resistant material 72, is inserted into a guide hole 74 of a ceiling 38, and is supported upwardly and downwardly movably by a hoisting and lowering drive device 76 via an up-and-down rod 75; a distance sensor 77 is provided in the ceiling 38 for detecting an altitudinal distance to an upper surface of a hearth 34 or to green compacts on the hearth 34; and the hoisting and lowering drive device 76 is driven in accordance with the results of detection by the distance sensor 77 so that a height position of the up-and-down partition plate 73 can be adjusted. Thus, even if the height of the green compacts on the hearth 34 varies with the amount of supply of the green compacts supplied onto the hearth 34, the gap between the lower end portion of the up-and-down partition plate 73 and the green compacts can be constantly maintained at an appropriate level, by adjusting the height position of the up-and-down partition plate 73. Consequently, flow of air inside the furnace can be suppressed reliably, and damage to the up-and-down partition plate 73 can be prevented.

[Fourth Embodiment]

Figure 9:
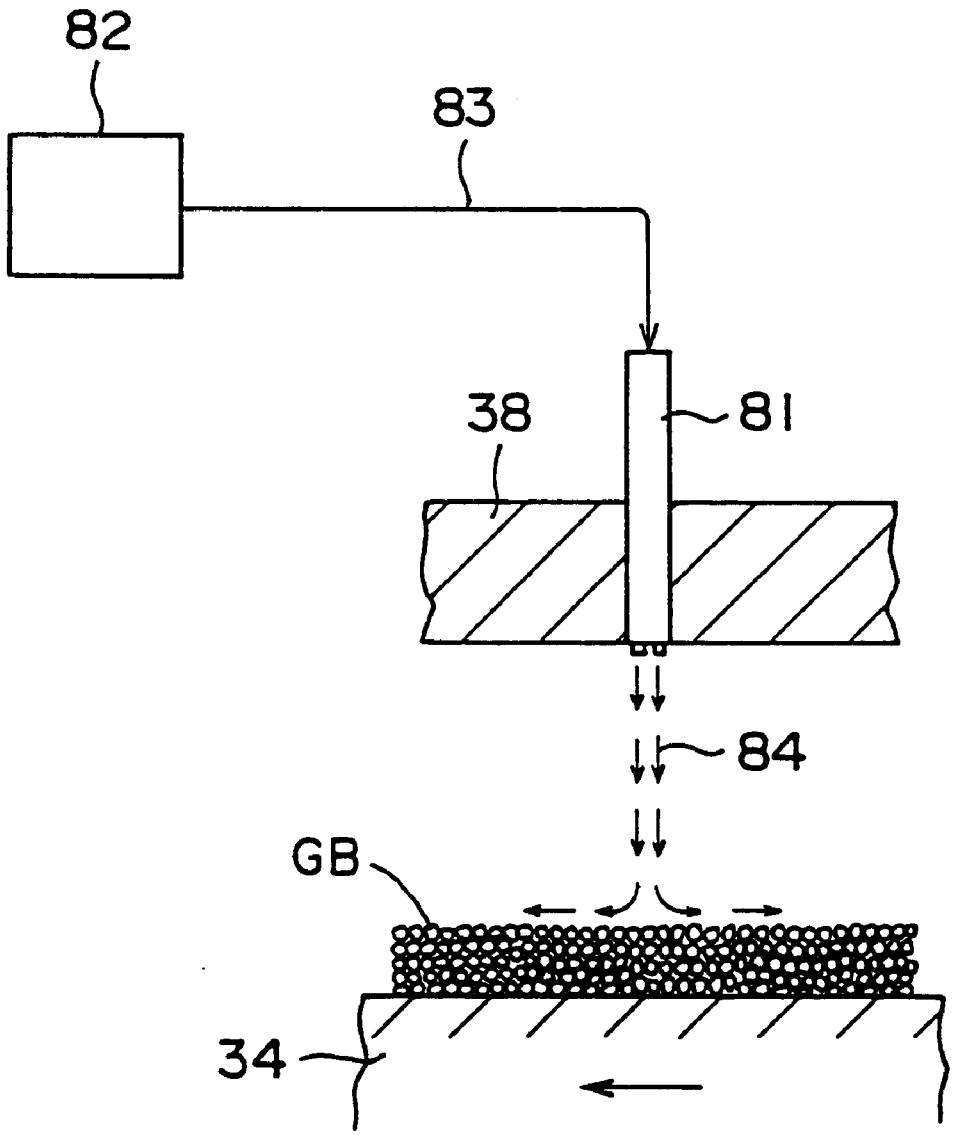
FIG. 9 is a vertical sectional view of an essential part of an RHF showing central partitioning means in an apparatus for producing reduced iron according to a fourth embodiment of the invention.

As shown in FIG. 9, central partitioning means in the fourth embodiment is constituted such that a gas ejection nozzle 81 is provided in a ceiling 38, and the gas ejection nozzle 81 is connected to a gas supply source 82 for an inert gas ($N_2$) by a gas supply line 83. The inert gas is supplied from the gas supply source 82 to the gas ejection nozzle 81 through the gas supply line 83. From the gas ejection nozzle 81, the inert gas is ejected toward green compacts on a hearth 34, whereby a gas curtain 84 can be formed. Thus, air flow inside the furnace can be easily suppressed.

[Fifth Embodiment]

Figure 10:
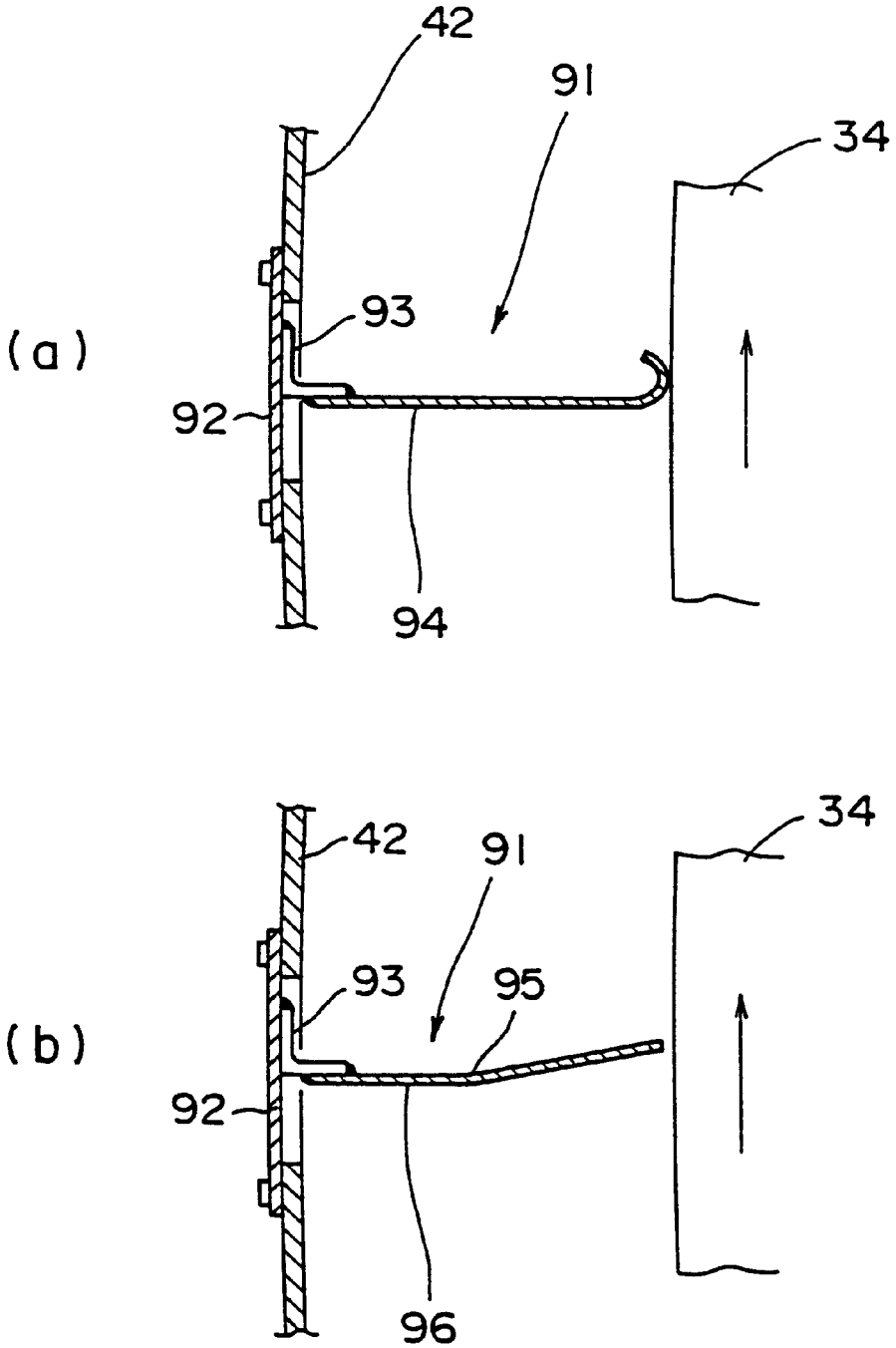
FIGS. 10(*a*) and 10(*b*) are vertical sectional views of an essential part of an RHF showing side partitioning means in an apparatus for producing reduced iron according to a fifth embodiment of the invention.

As shown in FIG. 10(*a*), a side partition plate 91, as side partitioning means in the fifth embodiment, comprises a partition plate body 94 coupled in a T-shape to a fixing plate 92 by an L-shaped connecting plate 93. The partition plate body 94 is elastically deformable, and has a rounded tip portion. The fixing plate 92 is fixed to a furnace wall-side skirt 42 by bolting or welding. As shown in FIG. 10(*b*), instead of the partition plate body 94, there may be used a dog-legged partition plate body 96 which is elastically deformable and which has a bend 95 at its middle part. Even if the front end portion of the side partition plate 91 contacts a side portion of a hearth 34, damage to the side partition plate 91 can be prevented, because the tip portion of the partition plate body 94 is rounded, or the middle part of the partition plate body 96 has the bend 95.

[Sixth Embodiment]

Figure 11:
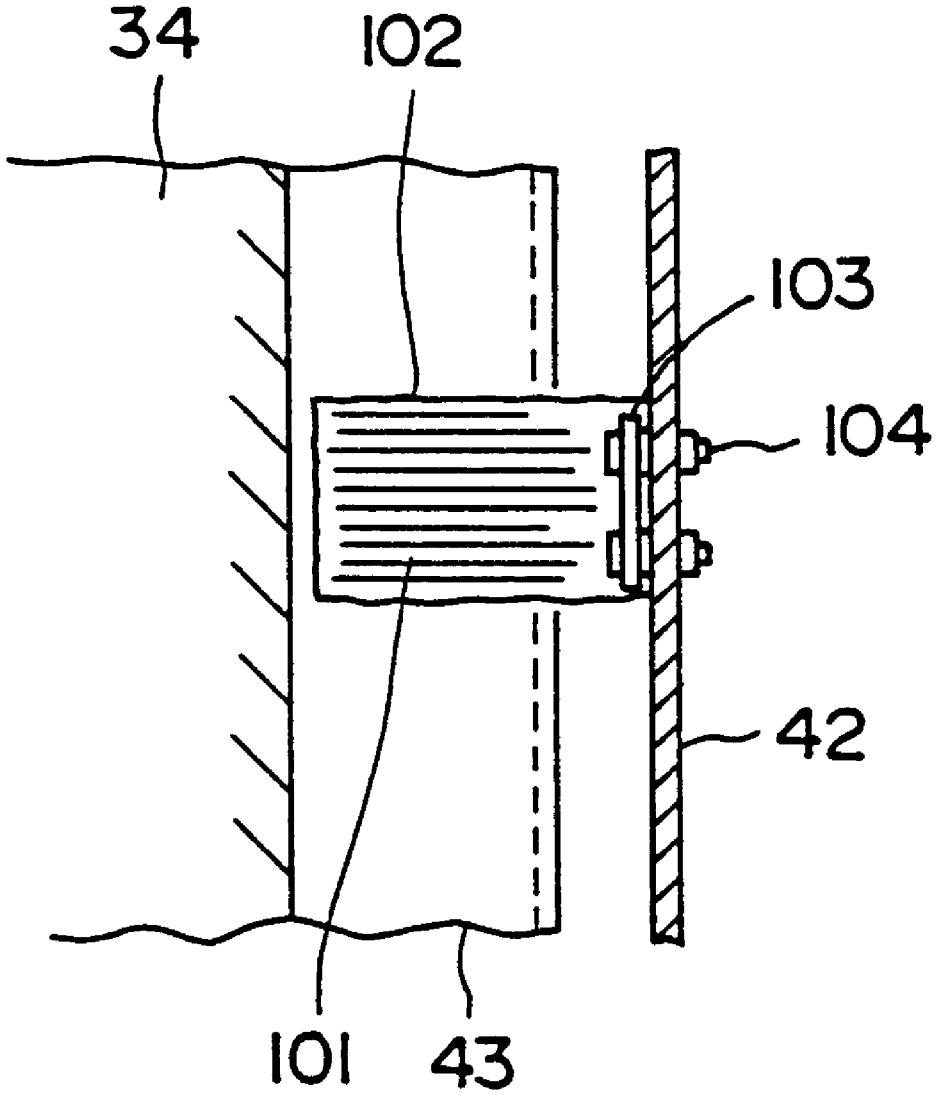
FIG. 11 is a vertical sectional view of an essential part of an RHF showing side partitioning means in an apparatus for producing reduced iron according to a sixth embodiment of the invention.

As shown in FIG. 11, side partitioning means in the sixth embodiment, like the central partitioning means shown in FIG. 7, is constituted by enveloping bulked ceramic fibers 101 in a woven fabric-like ceramic sheet 102 to form a mattress-like structure, and fixing this structure to a mounting bracket 103 by means of bolts 104. The mounting bracket 103 is fixed to a furnace wall-side skirt 42 to partition a passage space portion Q. Thus, the side partitioning means can be made lightweight and is flexible. Consequently, even if it contacts a hearth 34, it adapts to the motion of the hearth 34 and deforms, so that its damage can be prevented.

In the aforementioned embodiments, the side partition plates 54*a,* 54*b* and 54*c* are disposed, respectively, at the same positions as the central partition plates 53*a,* 53*b* and 53*c,* i.e., ahead of and behind the compact supply portion 44 and the compact discharge portion 45. However, they may be disposed in the gas passage space portion Q, excluding the compact supply portion 44 and the compact discharge portion 45.

[Seventh Embodiment]

Figure 12:
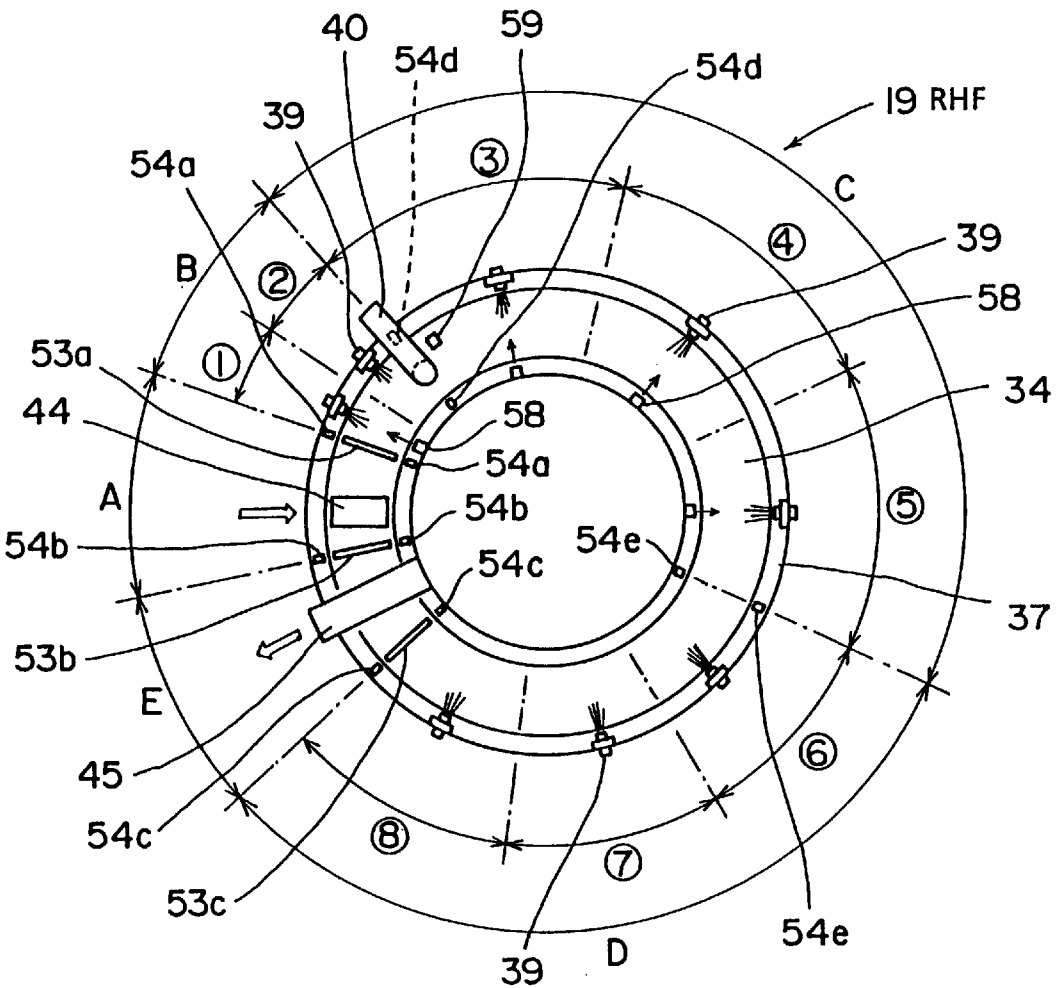
FIG. 12 is a schematic plan view of an RHF in an apparatus for producing reduced iron according to a seventh embodiment of the invention.
Figure 13:
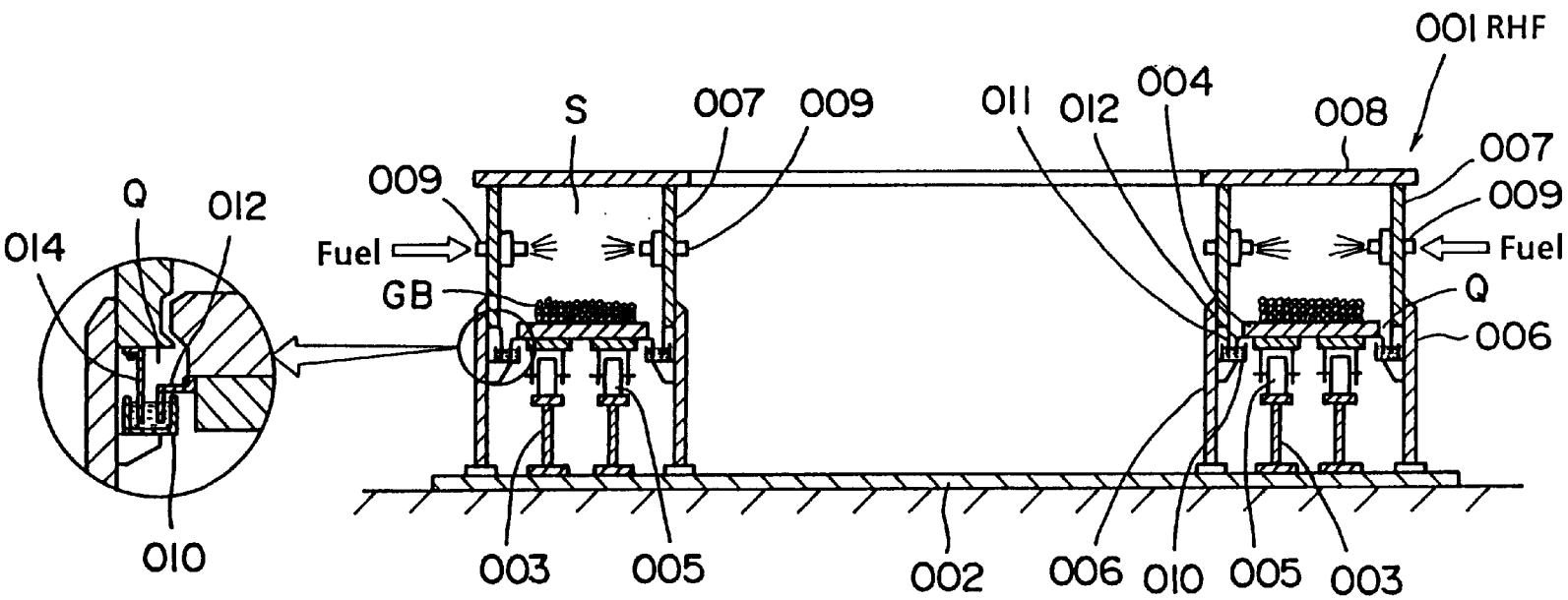
FIG. 13 PRIOR ART
FIG. 13 is a vertical sectional view of a conventional RHF.
Figure 14:
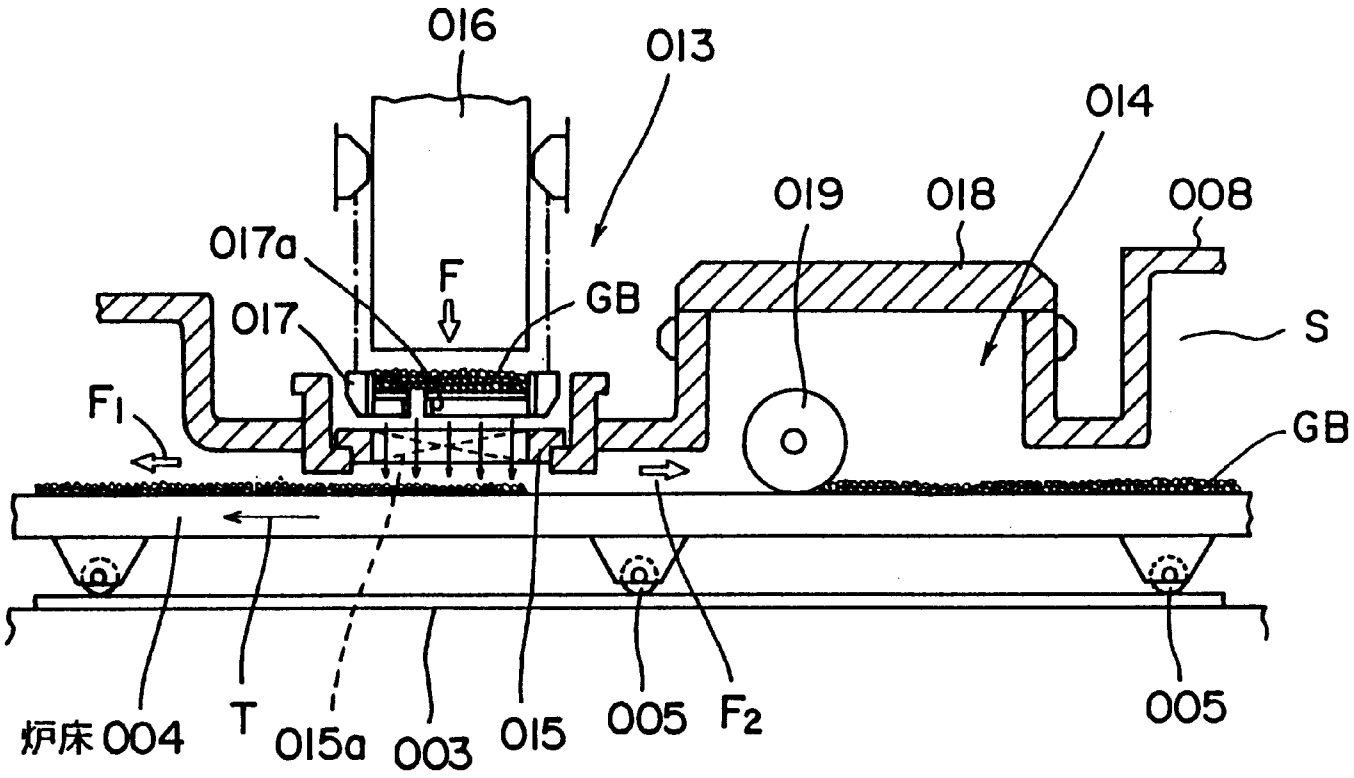
FIG. 14 PRIOR ART
FIG. 14 is a sectional view of a compact supply portion in the conventional RHF.

As shown in FIG. 12, a high temperature space portion S above a hearth 34 in an RHF 19 is divided into a compact supply zone A where green compacts are supplied by a compact supply portion 44, a heating zone B where the green compacts are heated by burners 39, a CO ratio control zone C where a CO ratio necessary for the reduction of the green compacts is controlled, a reducing atmosphere zone D where the green compacts are reduced, and a compact discharge zone E where the reduced green compacts are discharged by a compact discharge portion 45.

In the heating zone B, the burners 39 and an air supply portion 58 for supplying secondary combustion air are provided, and the heating zone B is divided into two zones, one beside the compact supply portion 44 and the other beside an off-gas duct 40. In the CO ratio control zone C, the burners 39 and air supply portions 58 for supplying secondary combustion air are provided, and also a CO and $C0_2$ sensor 59 is provided to control the CO ratio necessary for the reduction of the green compacts. That is, the CO ratio is determined by the ratio CO/ ($CO_2$+CO). The temperature inside the furnace attained by the burners 39, and the amount of secondary combustion air from the air supply portions 58 are controlled so that the CO ratio will take an appropriate value (e.g., 0.2). The CO ratio control zone C is divided into three zones. The reducing atmosphere zone D has a higher CO ratio than the heating zone B and the CO ratio control zone C, and forms a reducing atmosphere in which the green compacts are reducible. The reducing atmosphere zone D is divided into three zones.

As described above, the high temperature space portion S of the RHF 19 is divided into the heating zone B, the CO ratio control zone C, and the reducing atmosphere zone D, in addition to the compact supply zone A and the compact discharge zone E. A high temperature gas in the high temperature space portion S flows from the reducing atmosphere zone D toward the heating zone B, and is discharged through the off-gas duct 40, with the CO ratio being controlled appropriately. Thus, air flow in a gas passage space portion Q needs to be prevented in these zones B, C and D.

In the present embodiment, therefore, at least side partition plates 54*d,* 54*e* for defining the heating zone B, the CO ratio control zone C, and the reducing atmosphere zone D are provided, in addition to side partition plates 54*a,* 54*b* and 54*c* for defining the compact supply zone A and the compact discharge zone E. Thus, air flow in the gas passage space portion Q among the respective zones B, C and D can be suppressed, and the CO ratio can be controlled appropriately. Consequently, reduced iron having a high degree of metallization can be produced.

In the foregoing embodiments, the shape, structure, material, position of mounting, and method of mounting, of the central partition plates 53*a,* 53*b,* 53*c* and the side partition plates 54*a,* 54*b,* 54*c* have been described variously. However, the present invention is not restricted to them, and they may be set suitably in harmony with the shape of the RHF 19. Moreover, the constitution of the central partition plates 53*a,* 53*b,* 53*c* may be used for the side partition plates 54*a,* 54*b,* 54*c,* or vice versa.

What is claimed is:

1. An apparatus for producing reduced iron by agglomerating a mixed powder of an iron material and a reducing agent to form compacts like briquettes or pellets, and reducing the compacts in a high temperature atmosphere, comprising:

a rotary hearth in an annular form and rotatably supported;

frames for covering an area above the rotary hearth to form a high temperature atmosphere space portion;

a compact supply portion for supplying the compacts onto the rotary hearth;

a compact discharge portion for outwardly discharging reduced iron reduced on the rotary hearth; and supply portion partitioning means positioned at the both sides of said compact supply portion, said supply portion partitioning means is a partition between the compact supply portion and the high temperature atmosphere space portion.

2. The apparatus for producing reduced iron as claimed in claim 1, wherein discharge portion partitioning means is provided as a partition between the compact discharge portion and the high temperature atmosphere space portion.

3. The apparatus for producing reduced iron as claimed in claim 1, wherein the supply portion partitioning means is a partitioning member suspended from a ceiling of the frame and positioned above the rotary hearth.

4. The apparatus for producing reduced iron as claimed in claim 1, wherein the supply portion partitioning means is a partitioning member provided beside the rotary hearth.

5. The apparatus for producing reduced iron as claimed in claim 1, wherein:

the area above the rotary hearth is covered by the frame, whereby the high pressure atmosphere space portion is formed above the rotary hearth, and a gas passage space portion is formed beside the rotary hearth;

a water sealing portion is provided beside the rotary hearth, a lower end portion of a skirt beside the rotary hearth and a lower end portion of a skirt beside the frame are submerged in the water sealing portion; and partition plates as the supply portion partitioning means are provided in the high temperature atmosphere space portion and the gas passage space portion.

6. The apparatus for producing reduced iron as claimed in claim 1, wherein:

burners for heating the high temperature atmosphere space portion are provided in the frame; and an off-gas duct is provided for discharging a high temperature gas to keep an interior of the apparatus at a negative pressure.

7. The apparatus for producing reduced iron as claimed in claim 3, wherein:

the partitioning member is formed like a mattress by enveloping bulked ceramic fibers in a woven movable and flexible ceramic sheet, and is attached to the ceiling of the frame.

8. The apparatus for producing reduced iron as claimed in claim 3, further including:

moving means for moving the partitioning member upward and downward;

height detecting means for detecting a height of compacts on the rotary hearth; and control means for controlling operation of the moving means in accordance with results of detection by the height detecting means.

9. The apparatus for producing reduced iron as claimed in claim 3, wherein:

the partitioning member is formed by surrounding an entire surface of a steel plate as a core material with an incombustible heat resistant material.

10. The apparatus for producing reduced iron as claimed in claim 1, wherein:

the supply portion partitioning means is a gas curtain formed by ejecting an inert gas from a gas ejection nozzle formed in the frame toward the rotary hearth.

11. The apparatus for producing reduced iron as claimed in claim 4, wherein:

the partitioning member is a partition plate of stainless steel having flexibility and capable of elastic deformation.

12. The apparatus for producing reduced iron as claimed in claim 4, wherein:

the partitioning member is formed like a mattress by enveloping bulked ceramic fibers in a woven fabric-like ceramic sheet, and is attached to a side wall of the frame.

13. The apparatus for producing reduced iron as claimed in claim 1, wherein:

high temperature atmosphere space portion partitioning means is provided as partitions at least between a heating zone, a CO ratio control zone, and a reducing atmosphere zone in the high temperature atmosphere space portion.

* * * * *